US006024676A

United States Patent [19]

Eschenbach

[11] Patent Number: 6,024,676

[45] Date of Patent: Feb. 15, 2000

[54] COMPACT CROSS TRAINER EXERCISE APPARATUS

[76] Inventor: Paul William Eschenbach, 143 Lakeland Ave., Moore, S.C. 29369

[21] Appl. No.: 09/246,889

[22] Filed: Feb. 8, 1999

Related U.S. Application Data

[63] Continuation-in-part of application No. 08/871,371, Jun. 9, 1997.

[51] Int. Cl.[7] ..... A63B 22/04; A63B 69/16

[52] U.S. Cl. ..... 482/51; 482/52; 482/57

[58] Field of Search ..... 482/51–53, 57, 482/70, 71, 79, 80

[56] References Cited

U.S. PATENT DOCUMENTS

| | | | |
|---|---|---|---|
| 5,529,555 | 6/1996 | Rodgers | 482/57 |
| 5,611,758 | 3/1997 | Rodgers | 482/57 |
| 5,685,804 | 11/1997 | Whan-Tong et al. | 482/51 |
| 5,743,834 | 4/1998 | Rodgers | 482/51 |
| 5,800,315 | 9/1998 | Yu et al. | 482/57 |
| 5,865,712 | 2/1999 | Chang | 482/57 |

*Primary Examiner*—Stephen R. Crow

[57] ABSTRACT

The present invention relates to a standup exercise apparatus that simulates walking, jogging and climbing with arm exercise. More particularly, the present invention relates to an exercise machine having separately supported pedals for the feet and arm exercise coordinated with the motion of the feet.

Cross trainers guide the feet along a generally elliptical shaped curve to simulate the motions of jogging and climbing. Existing machines often produce user problems such as heel slap, numb toe and knee soreness with extended use. The present invention is an improved elliptical exercise machine capable of extended exercise with fewer user problems. The pedal stride length is determined by a horizontal control linkage while the pedal lift is determined by a vertical control linkage. Further, the cross trainer is adjustable to vary the motion of the elliptical stride length and height separately to accommodate users of different size and muscle development.

The design is compact to minimize floor space. Pedal motion has equivalent maximum horizontal forward and rearward velocities to minimize pedal accelerations that cause undue muscle and joint soreness. Handles are coupled to the rocker linkage for arm exercise.

23 Claims, 4 Drawing Sheets

COMPACT CROSS TRAINER EXERCISE APPARATUS

This application is a Continuation-in-Part of previous application Ser. No. 08/871,371 filed Jun. 9, 1997.

BACKGROUND OF THE INVENTION

1. Field

The present invention relates to a standup exercise apparatus that simulates walking and jogging with arm exercise. More particularly, the present invention relates to an exercise machine having separately supported pedals for the feet and arm exercise coordinated with the motion of the feet. The pedal stroke and pedal lift are controlled separately and can be varied.

2. State of the Art

The benefits of regular exercise to improve overall health, appearance and longevity are well documented in the literature. For exercise enthusiasts the search continues for safe apparatus that provides full body exercise for maximum benefit in minimum time.

Recently, a new category of exercise equipment has appeared on the commercial market called elliptical cross trainers. These cross trainers guide the feet along a generally elliptical shaped curve to simulate the motions of jogging and climbing. Generally they are large exercise machines using long cranks to generate a long foot stride. There is a need for a compact elliptical exercise machine capable of a similar long stride using a significantly shorter crank. Further, there is a need to adjust the length and lift of the elliptical stride to accommodate users of different proportions.

Numerous combinations of levers and cranks to combine exercise for arms and feet can be found. Hex in U.S. Pat. No. 4,645,200 combines arm and foot levers for sit down exercise while Bull et al. in U.S. Pat. No. 4,940,233 combines arm and foot levers for standup exercise. Lucas et al. in U.S. Pat. No. 4,880,225 offers oscillating arm levers coupled to the foot crank by a connecting rod. Dalebout et al. in U.S. Pat. Nos. 4,971,316 and 5,000,444 also shows oscillating swing arms coupled to the foot crank by an offset second crank and connecting rod. Lom in U.S. Pat. No. 4,986,533 offers oscillating arms driven by a crank-slider coupled to a foot crank.

Recently, there has been an effort to improve the up and down motion of stair climbers by the addition of horizontal movements. Habing in U.S. Pat. Nos 5,299,993 and 5,499,956 offers an articulated linkage controlled through cables by motor to move pedals through an ovate path. Both pedal pivots follow basically the same guidance path curve directed by a motor controller. Stearns in U.S. Pat. Nos. 5,290,211 and 5,299,993 shows a stair stepping exercise machine which incorporates horizontal movement using a combination of vertical parallelogram linkage and horizontal parallelogram linkage to guide the foot pedals. The parallelogram linkages serve to maintain the pedal at a constant angle relative to the floor during a pedal cycle. The pedal pivots move through similar undefined guide paths.

Standup cycling is described in various patents such as U.S. Pat. No. 3,563,541 (Sanquist) which uses weighted free pedals as load resistance and side to side twisting motion. Also U.S. Pat. Nos. 4,519,603 and 4,477,072 by DeCloux describe standup cycling with free pedals in a lift mode to simulate body lifting.

Standup pedal exercise is shown in U.S. Pat. No. 4,643,419 (Hyde) and by the DP Air Strider as previously sold by Diversified Products of Opelika, Ala. where pedal platforms move by dual crank motion but remain parallel to the floor. Knudsen in U.S. Pat. No. 5,433,680 shows an elliptical path generating mechanism with pedals having only one pivot allowing the pedal to rotate unconstrained about the pivot as in a bicycle crank.

Standup pedal exercise combined with arm levers attached to the pedals is shown in Kummerlin et al. German Pat. No. 2,919,494 and in Geschwender U.S. Pat. No. 4,786,050. Standup pedal exercise coupled with oscillating swing arms is shown in Miller U.S. Pat. Nos. 5,242,343 and 5,383,829 and in Eschenbach U.S. Pat. No. 5,423,729. All of these exercise machines use pedals having two pedal pivots which are guided by a first circular guide path curve generated by a crank which rotates through one full revolution during a pedal cycle and a second arc guide path curve generated by a rocker link or track.

Recently, numerous elliptical exercise machines have appeared in the patent literature. Rogers, Jr. in U.S. Pat. Nos. 5,527,246, 5,529,555, 5,540,637, 5,549,526, 5,573,480, 5,591,107, 5,593,371, 5,593,372, 5,595,553, 5,611,757, 5,637,058, 5,653,662 and 5,743,834 shows elliptical pedal motion by virtue of various reciprocating members and geared linkage systems. Miller in U.S. Pat. Nos. 5,518,473, 5,562,574, 5,611,756, 5,518,473, 5,562,574, 5,577,985, 5,755,642 and 5,788,609 also shows elliptical pedal motion using reciprocating members and various linkage mechanisms along with oscillating guide links with control links to determine pedal angles. The Elliptical Cross Trainer by Life Fitness of Franklin Park Ill. also generates elliptical pedal motion using an elongated pedal supported by rollers on one end and an offset crank mechanism on the other end.

Chang in U.S. Pat. No. 5,803,872 and Yu et al. in U.S. Pat. No. 5,800,315 show a pedal supported by a rocker link and driven with a pair of links located under the pedal pivotally connected to a crank. Maresh et al. in U.S. Pat. No. 5,792,026 show a foot support member supported by a rocker link and driven by a double crank mechanism. Lee in U.S. Pat. No. 5,779,598 and Chen in U.S. Pat. No. 5,823,914 show a pedal link driven by two separate cranks. Line et al. in U.S. Pat. No. 5,769,760 offers elliptical foot and hand motion. Sands et al. U.S. Pat. No. 5,755,643 shows elliptical foot motion with folding front post.

Lee in U.S. Pat. No. 5,746,683 shows a foot support member supported on one end with a compound rocker wherein a slider and handle lever support the rocker. Kuo in U.S. Pat. No. 5,836,854 offers a linear foot support member connected on one end to a crank and guided along an arcuate curve under the pedal by a linkage on the other end. Wang et al. U.S. Pat. No. 5,830,112 shows a foot support member sliding on a pivot on one end and attached to a crank on the other that can fold. Chen U.S. Pat. No. 5,823,917 shows a foot support member driven by a crank on one end and supported by a stationary roller on the other. Chen U.S. Pat. No. 5,820,524 offers a slider crank mechanism having a pedal pivotally attached with a control link to articulate the pedal angle.

Chen U.S. Pat. No. 5,779,599 and 5,762,588 shows an elliptical pedal movement with a roller interface between the foot support member and crank. Chen in U.S. Pat. No. 5,759,136 shows a foot support member with a moving pedal for adjustable elliptical motion wherein a link from the pedal to the crank can be repositioned to change the pedal stroke length. Kuo U.S. Pat. No. 5,846,166 shows a foot support member guided on one end by a roller and driven on the other end by a four bar linkage. Stearns et al. in U.S. Pat.

No. 5,848,954 offers a foot support member pivoted on one end with a lift crank on the other and a pedal moving on the foot support member to generate elliptical type foot motion.

There is a need for a pedal operated exercise machine that can be safely operated in the standup position whereby the arms and legs can be exercised with the feet moving through a generally elliptical path wherein the stride length and pedal lift are independently variable.

It is one objective of this invention to provide an elliptical pedal movement wherein the pedal stroke length is generated by a horizontal control linkage while the pedal lift is determined by a vertical control linkage. Another object of this invention is to provide arm exercise that is coordinated with the pedal movement.

SUMMARY OF THE INVENTION

The present invention relates to the kinematic motion control of pedals which simulate walking and jogging during operation. More particularly, apparatus is provided that offers variable intensity exercise through a leg operated cyclic motion in which the pedal supporting each foot is guided through successive positions during the motion cycle while a load resistance acts upon the mechanism.

The pedals are guided through an oblong or elongate curve motion while pedal angles are controlled to vary about the horizontal during the pedal cycle. Arm exercise is by arm levers coordinated with the mechanism guiding the foot pedals.

In the preferred embodiment, the apparatus includes a separate pedal for each foot, each pedal is supported by a foot support member which is pivotally attached on one end to a rocker link guide pivoted to the framework. The foot support member is further supported vertically by a set of rollers rotatably attached to the foot support member. A crank completes one full revolution during a pedal cycle and is phased generally opposite the crank for the other foot support link through a bearing journal attached to the framework.

The foot support member horizontal movement is determined by a horizontal control linkage comprising the rocker link and a coupler link pivotally attached to the rocker link and to the crank. The pedal lift is determined by a vertical control linkage comprising a track rollably engaged with the foot support roller and supported by a pair of track support links pivotally connected to the framework and a connecting link pivotally attached to one of the track support links and the crank. An offset crank attachment or a pivot on the coupler link could also be used to connect the connecting link for phase adjustment when necessary and remain within the scope of this invention.

As the crank rotates, the rocker link guides the forward end of the foot support member and pedal through a predetermined horizontal stroke length determined by the position of the coupler link pivot on the rocker link. Additional pivot positions are available on the rocker link to change the horizontal stroke length.

With crank rotation, the track moves up and down with a predetermined lift as the connecting link reciprocates one of the track support links. The track and pair of track support links form a parallelogram linkage wherein the track reciprocates through parallel positions. However, the parallel track positions are desirable but not necessary for the present invention. The predetermined track lift results in a predetermined pedal lift which is phased to the horizontal pedal stroke. Additional pivot positions are available on the track support link for the connecting link attachment to vary the predetermined pedal lift independently of the horizontal pedal predetermined stroke length.

A pair of handles for arm exercise are attached to the rocker links. The range of hand movement will increase with longer pedal movement for taller operators and decrease with shorter pedal strokes for shorter operators when the coupler link pivot is repositioned on the rocker links. It is understood that the handles for arm exercise could be attached to other moving links within the scope of the present invention.

In an alternate embodiment, the rollers supporting the foot support member are rotatably attached to a support fulcrum which is pivotally connected to the framework. The foot support member has a track underneath in rollable contact with the rollers. The connecting link of the preferred embodiment is now pivotally attached to the support fulcrum. The vertical pedal lift is now controlled by reciprocation of the support fulcrum in phase with the horizontal control linkage which is the same as the preferred embodiment. Operation, arm exercise, stroke adjustment and lift adjustment are similar to the preferred embodiment.

In another alternate embodiment, a second crank is added to the vertical control linkage. The second crank can be phased to the first crank with angular advance or retardation with the same or opposite direction of rotation using timing belts or gears. The connecting link is now pivotally attached to the second crank. A variety of elongate curve shapes are possible with phasing and direction of rotation changes.

In each embodiment, the pedal is moved by the foot of the user where the pedal follows an elongate curve path while the foot support link moves back and forth as predetermined by the rocker stroke and pedal lift. The length and height of the elongate curve path can be independently varied. The maximum horizontal pedal velocity forward is approximately the same as the maximum horizontal pedal velocity rearward. It is understood that other embodiments of horizontal and vertical control linkage may be used within the scope of the present invention to generate similar or different elongate pedal paths.

Load resistance is applied to the crank in each embodiment by a pulley which drives a belt to a smaller pulley attached to an alternator and flywheel supported by the framework. In each embodiment, the flywheel must overcome the torque provided by the alternator. Adjustment of the alternator electronics provides variable intensity exercise for the operator.

In summary, this invention provides the operator with stable foot pedal support having adjustable motions that simulate walking and jogging with very low joint impact while offering variable strides during operation from a compact machine with coordinated upper body exercise.

DETAILED DESCRIPTION OF THE EMBODIMENTS

Figure 1:
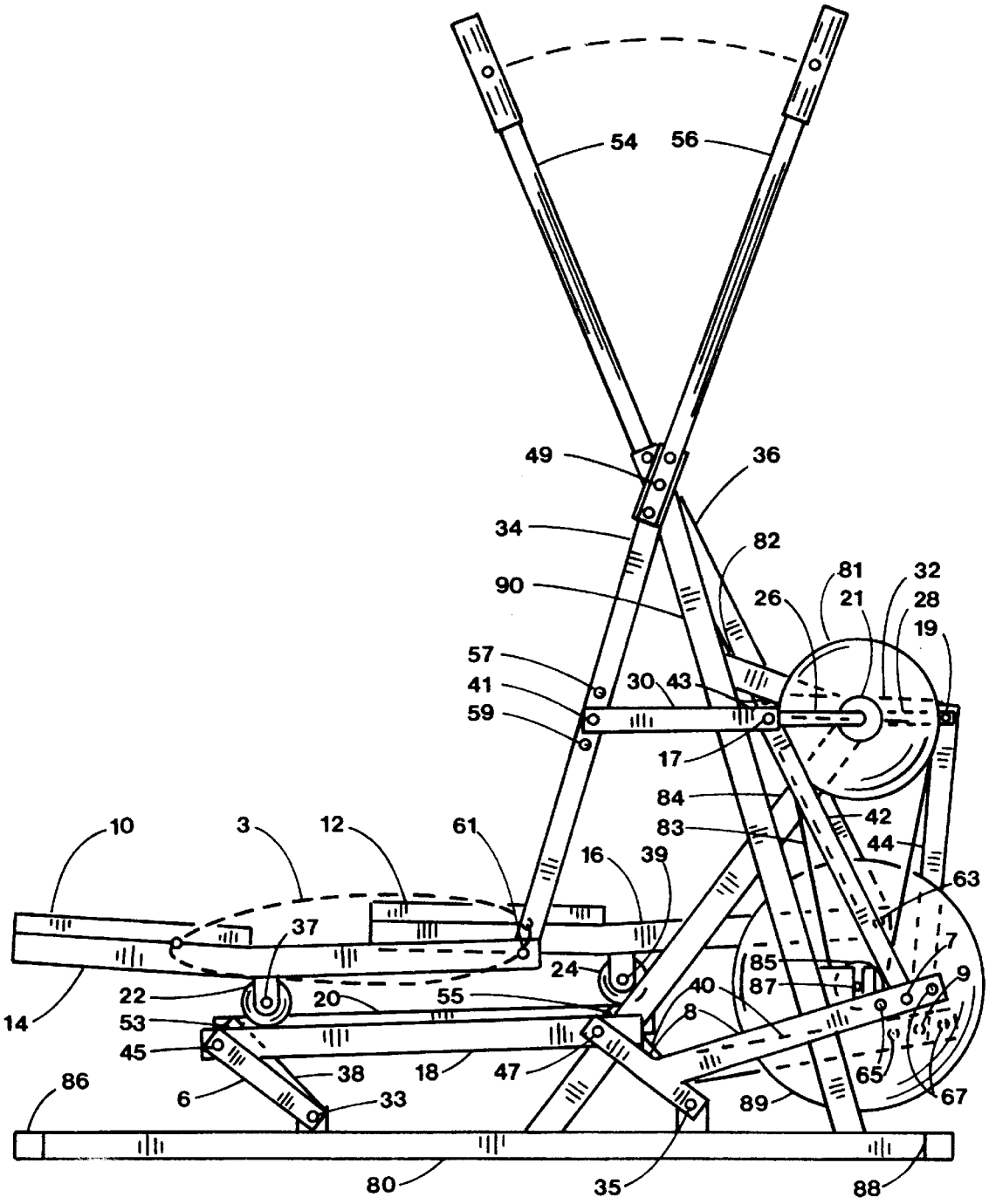
FIG. 1 is a right side elevation view of the preferred embodiment of an exercise machine constructed in accordance with the present invention.
Figure 2:
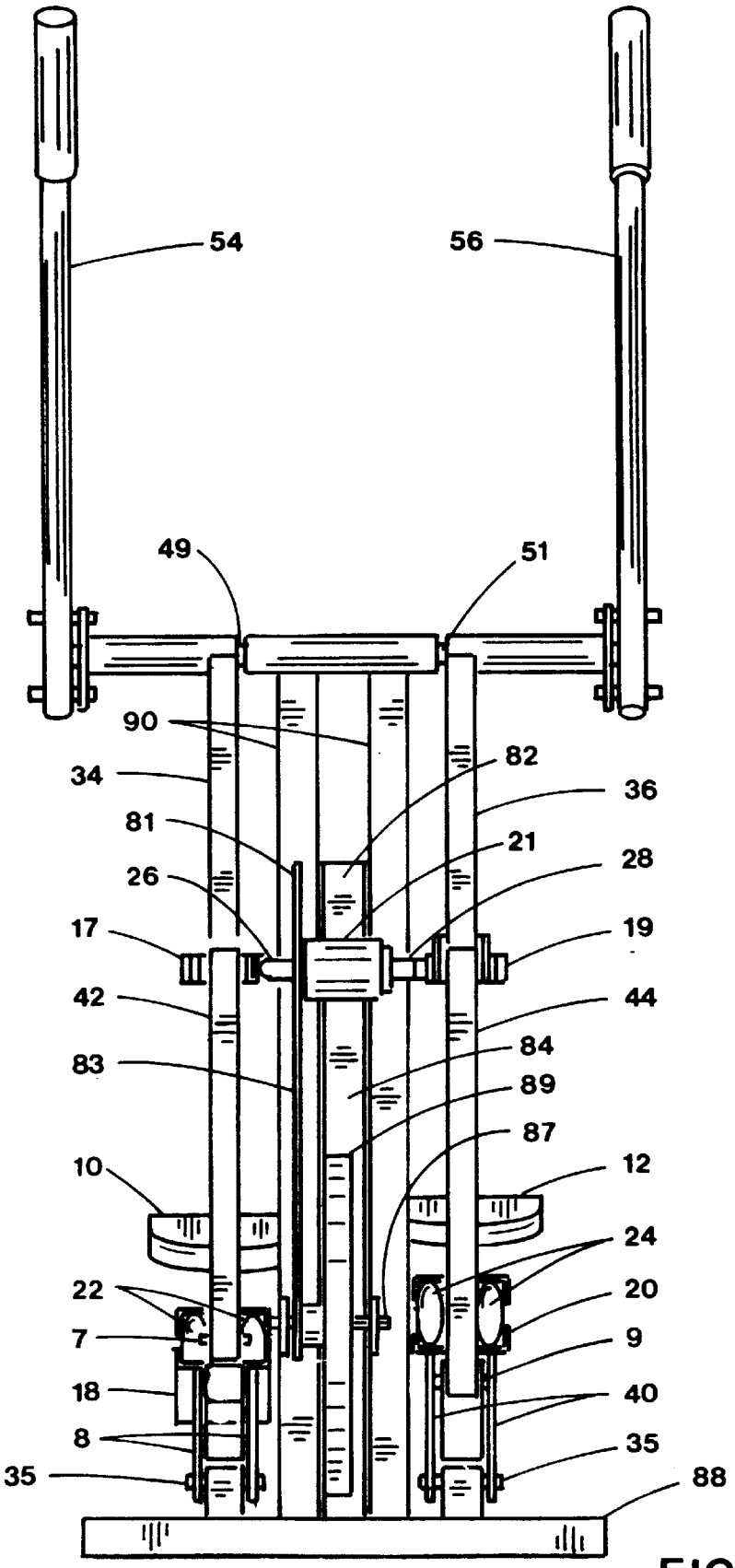
FIG. 2 is the front view of the preferred embodiment shown in FIG. 1.

Referring to the drawings in detail, pedals 10 and 12 are shown in FIGS. 1 and 2 in the most forward and rearward positions of the preferred embodiment. Pedals 10 and 12 are attached to foot support members 14,16 which are connected to rocker links 34,36 at pivots 61,63 at one end and further supported by roller set 22,24 making rolling contact with foot support tracks 18,20. Rocker links 34,36 are connected to frame member 90 at pivots 49,51. Roller set 22,24 are rotatably connected to foot support members 14,16 at bearings 37,39.

Crank arms 26,28 with crank pins 17,19 are joined inside bearing housing 21 which is attached to frame members 82,84 and protrude outwardly in generally opposing directions to comprise a crank. Coupler links 30,32 are attached to rockers 34,36 at pivots 41,43 and to crank pins 17,19. Rotation of crank arms 26,28 results in reciprocation of rockers 34,36 with a predetermined horizontal stroke. Rockers 34,36 and coupler links 30,32 form a horizontal control linkage interfacing with crank arms 26,28 and foot support members 14,16 to determine the pedal 10,12 stroke. Additional pivot locations 57,59 are available on rockers 34,36 to reposition coupler pivot 41,43 to change the horizontal stroke length.

Foot support tracks 18,20 are supported by a pair of track support links 6,8 and 38,40 which are attached to tracks 18,20 at pivots 45,47 and 53,55 and to pivots 33,35 on frame member 80. Track support links 8,40 have extensions for pivots 7,9 that attach to connecting links 42,44 which are connected to crank pins 17,19. Track 18, track support links 6,8 and track 20, track support links 38,40 form parallelograms that reciprocate tracks 18,20 with generally parallel angular movement while crank arms 26,28 rotate. Tracks 18,20, track support links 6,8,38,40 and connecting links 42,44 form a vertical control linkage which determines pedal lift. Additional pivot locations 65,67 are available on track support links 8,40 to reposition connecting link pivot 7,9 to change the pedal lift independent of the pedal stroke length.

Figure 3:
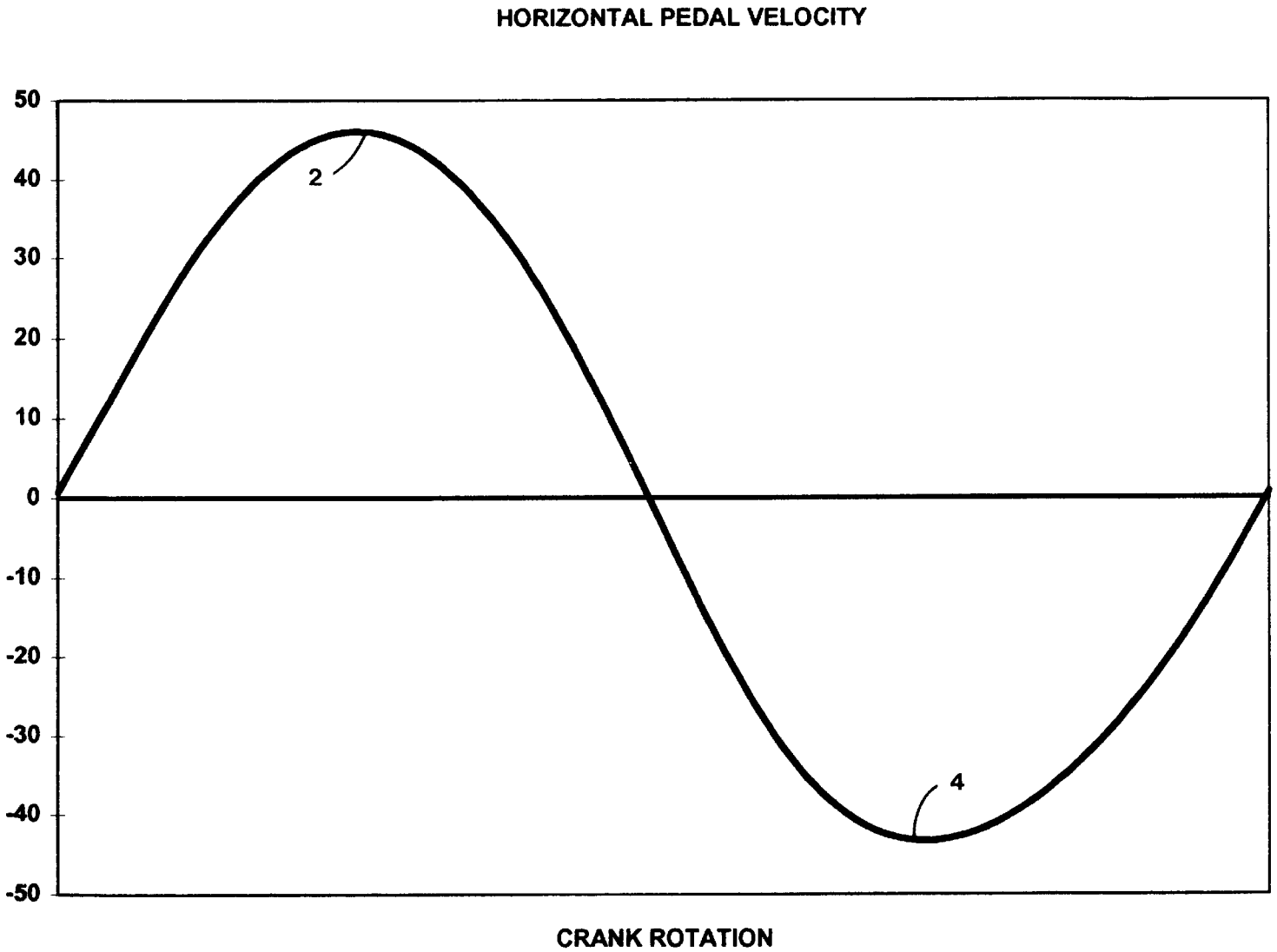
FIG. 3 is a horizontal pedal velocity profile for the preferred embodiment.

Operation of foot pedals 10,12 cause crank arms 26,28 to rotate in conjunction with the horizontal and vertical control linkages while the foot pedals 10,12 follow elongate curve 3 shown in FIG. 1. Repositioning of coupler pivots 41,43 would change the length of elongate curve 3 while repositioning the connecting link pivots 7,9 will change the height of elongate curve 3. The preferred embodiment is configured wherein the maximum horizontal pedal velocity forward 2 and rearward 4 are approximately the same as shown in FIG. 3.

Handles 54,56 are attached to rocker links 34,36 to provide arm exercise. Frame member 80 connects cross members 86,88 which contact the floor for support of the exercise machine. Frame member 90 is attached to frame member 80 to support rocker pivots 49,51. Frame members 82,84 are attached to frame members 80 and 90 to support crank bearing housing 21.

Load resistance is imposed upon cranks 26,28 by pulley 81 which drives flywheel/alternator 89 by belt 83 coupled to pulley 85. The flywheel/alternator 89 is supported by the frame member 90 at shaft 87. Other forms of load resistance may also be used.

Application of body weight on the pedals 10,12 causes the pedals 10,12 to follow elliptical curve 3 shown in FIG. 1 and together with force applied at the arm levers 54,56 cause the linkage to rotate the flywheel 89 for a gain in momentum. This flywheel 89 momentum will carry the linkage system through any dead center positions of the crank 26,28. The pedals 10,12 and arm levers 54,56 can be operated to drive the flywheel 89 in either direction of rotation.

Figure 4:
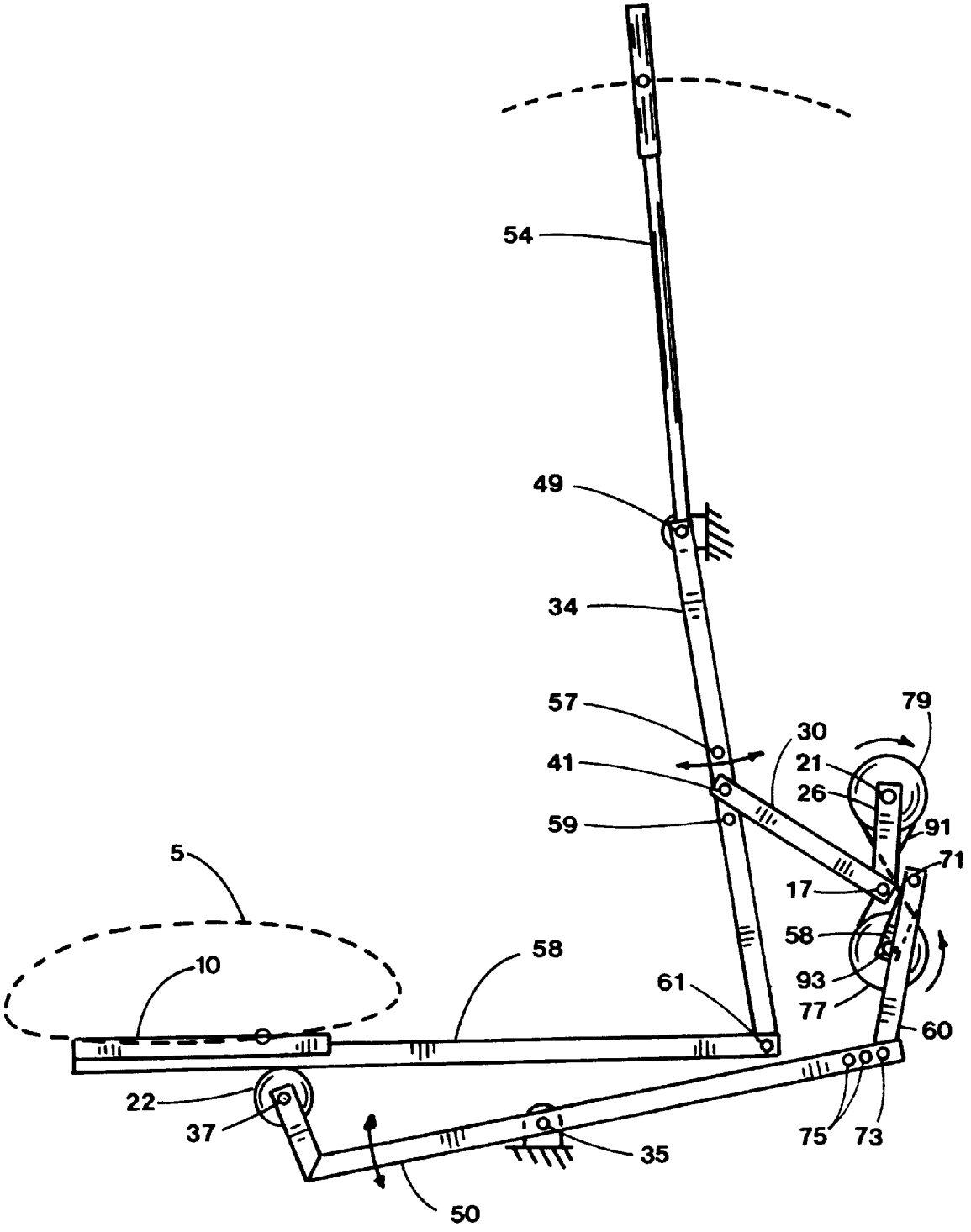
FIG. 4 is a right side schematic of an alternate embodiment showing only the left hand linkage members.

An alternate embodiment is shown in FIG. 4 with pedal 10 in the lowermost position with only the right hand linkage system shown for clarity. The horizontal control linkage, rocker link 34 and coupler link 30, and crank 26 are the same as the preferred embodiment. The foot support member 58 having pedal 10 is attached to rocker link 34 at pivot 61 and is further supported underneath by rollers 22. Rollers 22 are rotatably attached to fulcrum 50 which is attached to frame pivot 35. Fulcrum 50 extend beyond pivot 35 for attachment to connecting link 60 at pivot 73.

A second crank 58 has bearing housing 93 rotatably attached to the frame and is attached to connecting link 60 at pivot 71. Pulley 79 is attached to crank 26 and is rotatably engaged with pulley 77 attached to crank 58 by timing belt 91. Belt 91 is shown twisted to reverse the direction or rotation for pulley 77. Gears, timing belt without twist or other form of rotary transmission can also be used to phase crank 26 to crank 58 within the scope of the present invention. The vertical control linkage includes roller 22, fulcrum 50, connecting link 60 and crank 58 that determines pedal 10 lift.

Operation of foot pedals 10,12 cause crank arms 26,28 to rotate in conjunction with the horizontal and vertical control linkages while the foot pedals 10,12 follow elongate curve 5 shown in FIG. 4. Repositioning of coupler pivot 41 to alternate pivot 57 or 59 would change the length of elongate curve 5 while repositioning the connecting link 60 to pivot 75 will change the height of elongate curve 5.

The horizontal and vertical control linkage, handle 56, pedal 12, foot support member 16 and crank 28 for the left hand side are not shown for clarity. The framework 80,86, 88,90 and load resistance are the same as the preferred embodiment and are not shown for clarity.

In summary, the present invention has distinct advantages over prior art because the back and forth stride movement of the pedals and the pedal lift are phased separately. This allows separate determination of pedal stroke and pedal lift. Further, similar maximum pedal velocities forward and rearward remain after alternate pedal stroke and lift determination. Phasing of the vertical control linkage relative to the horizontal control linkage or crank allows different elongate curve paths.

The present invention may be embodied in other specific forms without departing from its spirit or essential characteristics. The described embodiments are to be considered in all respects only as illustrative, and not restrictive. The scope of the invention is, therefore, indicated by the claims, rather than by foregoing description. All changes which come within the meaning and range of equivalency of the claims are to be embraced within their scope.

What is claimed is:

1. An exercise machine comprising:

a framework configured to be supported by the floor;

a crank means rotatably connected to said framework, said crank means projecting outwardly therefrom on both sides thereof;

a pair of foot support members, each said foot support member having a foot engaging pedal means;

a horizontal control linkage having a plurality of links operably associated with said crank means and said foot support members, said horizontal control linkage configured to control back and forth movement of said pedal means;

a vertical control linkage having a plurality of links operably associated with said crank means and said foot support members, said vertical control linkage configured to control up and down movement of said pedal means;

said pedal means, include roller means which are associated with said vertical control linkages to move relative to said framework when the foot of the user is rotating said crank means whereby said pedal means follows an elongate curve path.

2. The exercise machine according to claim 1 wherein said horizontal control linkage further comprises means to adjust the horizontal stroke length of said pedal means.

3. The exercise machine according to claim 2 further comprising means to adjust the up and down movement of said pedal means.

4. The exercise machine according to claim 1 wherein said horizontal control linkage comprises a rocker link pivotally connected to said foot support member and said framework, and a coupler link pivotally attached to said rocker link and said crank means to provide back and forth movement of said pedal means.

5. The exercise machine according to claim 1 wherein said vertical control linkage comprises a track means pivotally supported by a pair of link means, said link means pivotally attached to said framework;

a connecting link pivotally attached to one of said link means and to said crank means;

said roller means rotatably attached to said foot support member and operably associated with said track means whereby said vertical control linkage provides up and down movement of said pedal means.

6. The exercise machine according to claim 1 wherein said vertical control linkage comprises a track means associated with said foot support member;

a fulcrum means, said fulcrum means pivotally attached to said framework;

a connecting link pivotally attached to said fulcrum means and said crank means;

said means rotatably attached to said fulcrum means and rollably associated with said track means whereby said vertical control linkage provides up and down movement of said pedal means.

7. The exercise machine according to claim 1 further comprising a load resistance means operably associated with said crank means.

8. The exercise machine according to claim further comprising a pair of handle means, each said handle means operably associated with said horizontal control linkage to provide arm exercise coordinated with said pedal means.

9. The exercise machine according to claim wherein said pedal means follows an elongate curve whereby the maximum forward velocity is generally the same as the maximum rearward velocity.

10. The exercise machine according to claim 1 wherein said vertical control linkage further includes a second crank means rotatably attached to said framework and operably associated with said crank means.

11. An exercise machine comprising:

a framework configured to be supported by the floor;

a crank means rotatably connected to said framework, said crank means projecting outwardly therefrom on both sides thereof;

a pair of coupler links, each said coupler link pivotally attached to said crank means;

a pair or rocker links, each said rocker link pivotally connected to said framework and to said coupler link;

a pair of foot support members having foot engaging pedal means, each said foot support member pivotally connected proximate one end to said rocker link;

a pair of roller means, each said roller means rotatably attached to said foot support member;

a pair of track means, each track means rollably engaged with said roller means;

a pair of track support links for each track means, each said track support link pivotally connected to said track means and to said framework;

a pair of connecting links, each said connecting link operably associated with said crank means and one of said track support links;

said pedal means configured to move relative to said framework when the foot of the user is rotating said crank means whereby the up and down movement of said pedal means is controlled by said track means and the back and forth movement of said pedal means is controlled by said rocker means.

12. The exercise machine according to claim 11 further comprising a pair of handle means, each said handle means connected to said rocker link for arm exercise.

13. The exercise machine according to claim 11 wherein said coupler link can be repositioned relative to said rocker link resulting in a change of the stroke length of said pedal means during rotation of said crank means.

14. The exercise machine according to claim 11 wherein said connecting link can be repositioned relative to said track support link resulting in a change of lift of said pedal means during rotation of said crank means.

15. The exercise machine according to claim 11 wherein said pedal means follows an elongate curve whereby the maximum forward velocity is generally the same as the maximum rearward velocity.

16. The exercise machine according to claim 11 further comprising a load resistance means operably associated with said crank means.

17. The exercise machine according to claim 11 further comprising a second crank means rotatably attached to said framework and pivotally connected to said connecting link, said second crank means operably phased with said crank means.

18. An exercise machine comprising:

a framework configured to be supported by the floor;

a crank means rotatably connected to said framework, said crank means projecting outwardly therefrom on both sides thereof;

a pair of coupler links, each said coupler link pivotally attached to said crank means;

a pair of rocker links, each said rocker link pivotally connected to said framework and to said coupler link;

a pair of foot support members having foot engaging pedal means, each said foot support member pivotally connected proximate one end to said rocker link;

a pair of roller means, each said roller means rotatably engaged with one of said foot support members;

a pair of fulcrum means, each said fulcrum means pivotally attached to said framework and rotatably supported one of said roller means;

a pair of connecting links, each said connecting link operably associated with said crank means and one of said fulcrum means;

said pedal means configured to move relative to said framework when the foot of the user is rotating said crank means whereby the up and down movement of said pedal means is controlled by said fulcrum means and the back and forth movement of said pedal means is controlled by said rocker means.

19. The exercise machine according to claim 18 further comprising a pair of handle means, each said handle means connected to said rocker link for arm exercise.

20. The exercise machine according to claim 18 wherein said coupler link can be repositioned relative to said rocker link resulting in a change of the stroke length of said pedal means during rotation of said crank means.

21. The exercise machine according to claim 18 wherein said connecting link can be repositioned relative to said fulcrum means resulting in a change of lift of said pedal means during rotation of said crank means.

22. The exercise machine according to claim 18 wherein said pedal means follows an elongate curve whereby the maximum forward velocity is generally the same as the maximum rearward velocity.

23. The exercise machine according to claim 18 further comprising a second crank means rotatably attached to said framework and pivotally connected to said connecting link, said second crank means operably phased with said crank means.

* * * * *